US009347284B2

(12) United States Patent
Beg et al.

(10) Patent No.: US 9,347,284 B2
(45) Date of Patent: May 24, 2016

(54) SLUG MITIGATION SYSTEM FOR SUBSEA PIPELINES AND RISERS

(71) Applicant: Caltec Limited, Bedfordshire (GB)

(72) Inventors: Mirza Najam Ali Beg, Milton Keynes (GB); Syed Mahmood Peeran, Milton Keynes (GB); Mir Mahmood Sarshar, Buckinghamshire (GB); Rhodri John Jones, London (GB)

(73) Assignee: Caltec Limited, Bedfordshire (GB)

( * ) Notice: Subject to any disclaimer, the term of this patent is extended or adjusted under 35 U.S.C. 154(b) by 0 days.

(21) Appl. No.: 14/540,817

(22) Filed: Nov. 13, 2014

(65) Prior Publication Data

US 2015/0136411 A1 May 21, 2015

(30) Foreign Application Priority Data

Nov. 15, 2013 (GB) ..... 1320205.6

(51) Int. Cl.

| | |
|---|---|
| ***E21B 21/06*** | (2006.01) |
| ***E21B 34/04*** | (2006.01) |
| ***E21B 21/00*** | (2006.01) |
| ***E21B 17/01*** | (2006.01) |
| ***E21B 43/12*** | (2006.01) |

(52) U.S. Cl.

CPC ..... *E21B 21/063* (2013.01); *E21B 17/01* (2013.01); *E21B 21/001* (2013.01); *E21B 34/04* (2013.01); *E21B 43/12* (2013.01)

(58) Field of Classification Search

CPC ..... E21B 21/063; E21B 21/001; E21B 34/04; E21B 17/01

USPC ..... 166/357

See application file for complete search history.

(56) References Cited

U.S. PATENT DOCUMENTS

| | | | | |
|---|---|---|---|---|
| 3,500,943 | A * | 3/1970 | Bingman, Jr. | 175/66 |
| 5,570,744 | A * | 11/1996 | Weingarten et al. | 166/357 |
| 6,197,095 | B1 * | 3/2001 | Ditria et al. | 95/248 |
| 8,801,938 | B2 * | 8/2014 | Allen | 210/747.4 |
| 2006/0151167 | A1 * | 7/2006 | Aarvik et al. | 166/267 |

FOREIGN PATENT DOCUMENTS

| | | | | |
|---|---|---|---|---|
| GB | 2468973 | | 9/2010 | |
| GB | 2478231 | | 8/2011 | |
| GB | 2478231 | A * | 8/2011 | E21B 43/34 |
| WO | 9318279 | | 9/1993 | |
| WO | WO 02/063135 | * | 1/2002 | E21B 43/34 |

OTHER PUBLICATIONS

GB Search Report, GB application No. 1320205.6, dated May 2, 2014.

* cited by examiner

*Primary Examiner* — James G Sayre

(74) *Attorney, Agent, or Firm* — Great Lakes Intellectual Property, PLLC.

(57) ABSTRACT

A slug mitigation system for subsea pipelines includes a riser located between a low level and an upper (above sea-) level of a pipeline, where an inline separator, e.g. an "I-SEP", is located upstream of a first stage separator. A throttling valve or fixed restriction is located downstream or upstream in series with the inline separator. Further aspects may also include a surface jet pump upstream of the in-line separator and/or a cyclonic separator downstream of the in-line separator.

7 Claims, 5 Drawing Sheets

SLUG MITIGATION SYSTEM FOR SUBSEA PIPELINES AND RISERS

CROSS-REFERENCE TO RELATED APPLICATIONS

This application claims foreign priority benefits under 35 U.S.C. §119(a)-(d) to United Kingdom patent application number GB 1320205.6 filed Nov. 15, 2013, the disclosure of which is hereby incorporated in its entirety by reference in its entirety.

TECHNICAL FIELD

The present invention relates to improved arrangements for slug mitigation in subsea pipelines, such as risers, as used in the oil and gas industry and particularly, according to the invention, utilising an in line separator apparatus in such arrangements.

BACKGROUND TO THE INVENTION

In-line separator devices are known in the art. For example, WO2008/020155 and WO2009/047484 each describe improved in-line separator arrangements; also known as cyclonic and/or uniaxial separators. FIG. 1 illustrates an in-line separator according to WO2008/020155 which is referred to commercially as an "I-SEP". Furthermore, embodiments described by WO2009/047484 are known commercially as "Hi-SEP", illustrated by FIG. 2.

Likewise, jet pumps (a.k.a. surface jet pumps, SJPs, eductors or ejecters) are known. For example, EP0717818 relates to a surface jet pump where flow from a high pressure oil well is used to reduce the back pressure on low pressure wells. According to this document the source of motive flow is a high pressure well and the low pressure well is not gas lifted. This jet pump also incorporates an in-line separator, as illustrated by FIG. 3.

It has been recognised by the present inventors that:

- An I-SEP has been shown to absorb slug energy and calm the fluid flow down stream
- By making use of I-SEP technology it is possible to mitigate slug flow in pipelines and severe slugging in pipeline/riser systems
- An I-SEP has also been seen to influence flow regimes upstream in the piping and risers
- By making use of the I-SEP technology it is possible to mitigate slug flow at a higher production rate, i.e. less back pressure is required to mitigate the slug flow
- It is also possible to mitigate slug flow while producing a complete gas-liquid separation, thus debottlenecking the main 1$^{st}$ stage separator using this technology
- This system is applicable for any slugging type/situation

DETAILED DESCRIPTION OF THE INVENTION

Figure 1:
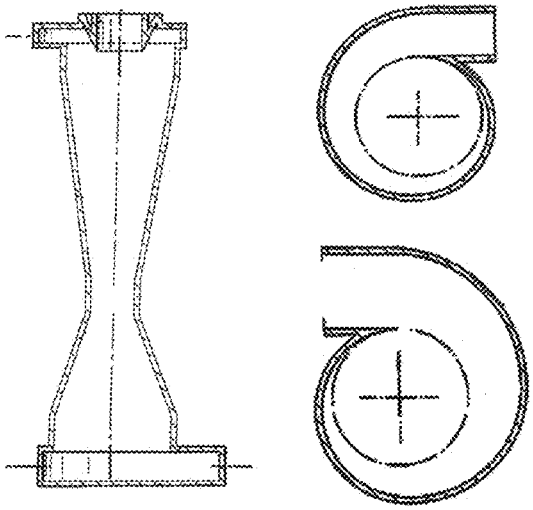
Fig. 1. Prior Art
FIG. 1 illustrates a section view of a prior art in-line separator.
Figure 2:
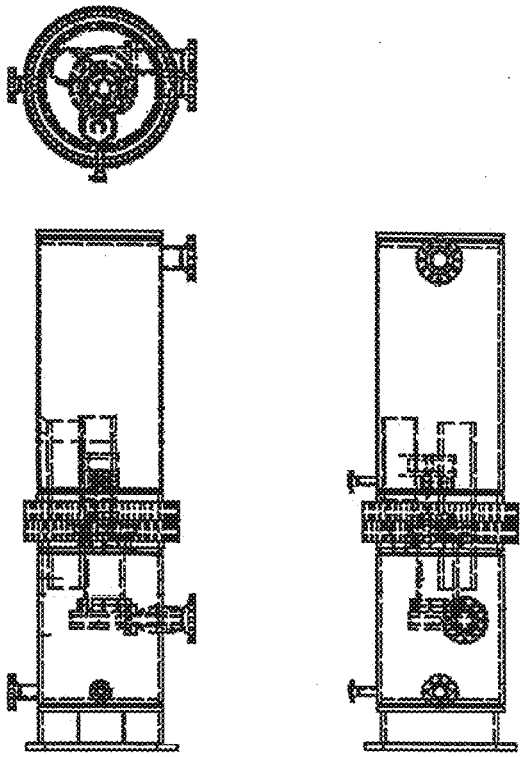
Fig. 2. Prior Art
FIG. 2 illustrates a section orthographic view of another prior art in-line separator.
Figure 3:
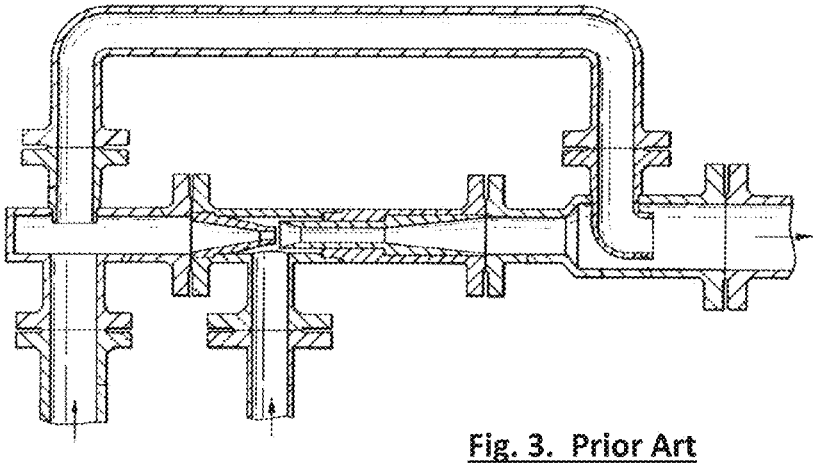
Fig. 3. Prior Art
FIG. 3 illustrates a prior art surface jet pump.
Figure 4:
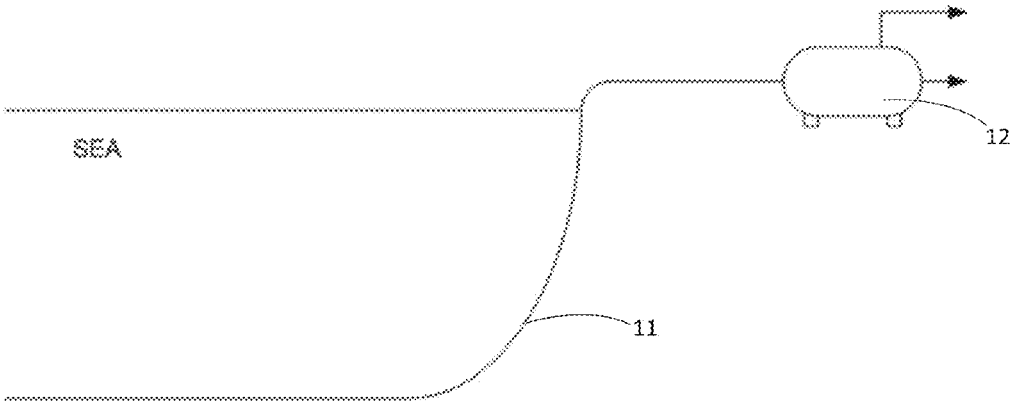
Fig. 4. Prior Art
FIG. 4 illustrates a general pipeline/riser system known in the art.

The invention has been designed to specifically reduce the effect of slugging on a pipeline riser/pipeline system for offshore oil and gas use. FIG. 4 shows a general pipeline/riser system where the flow from the wellhead flows along the seabed and enters a typical riser configuration 11 which connects the seabed pipeline to the topside processing/separation equipment, e.g. a first stage separator 12. The systems described herein can be used for severe slugging or any terrain induced slug flow that may be generated from the profile of a pipeline. A typical severe slugging regime has been used as an example to describe a solution but the invention is equally as effective for any slug flow regime.

Figure 5:
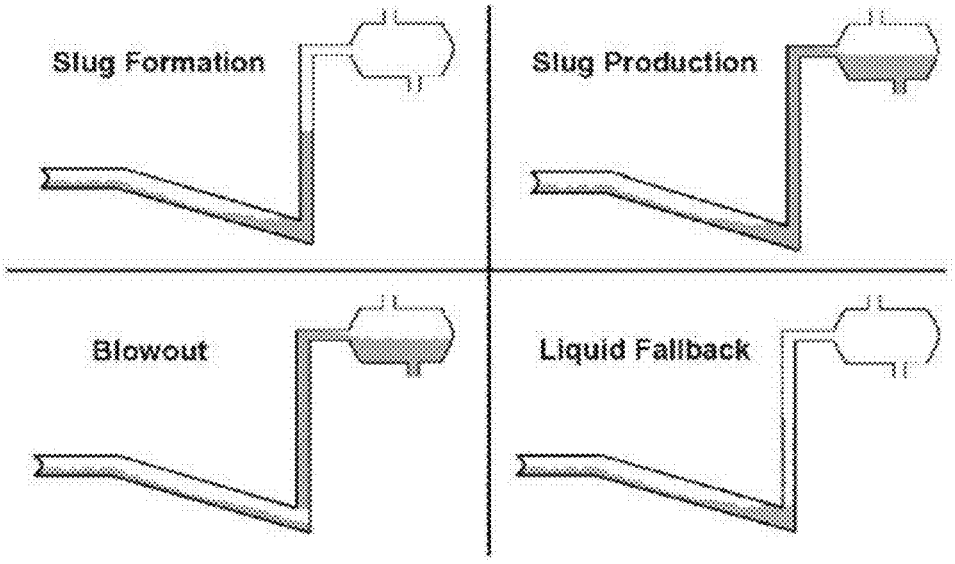
Fig. 5. Prior Art
FIG. 5 illustrates four cyclical stages of severe slugging, known in the art.

One of the major issues associated with the type of system illustrated by FIG. 4 is a flow regime described as severe slugging (mentioned above). Severe slugging occurs generally in four cyclical stages, as can be seen in FIG. 5. Severe slugging is the occurrence of a liquid slug that is at least one riser height in length and can be hundreds of metres in length. It is also known as terrain induced slugging because it usually occurs due to low points in a pipeline.

The most common four stages shown in FIG. 5 represent the cyclic nature of severe slugging, namely:

Stage 1: Liquid Fall Back—From the end of the previous cycle there is some liquid fall back down to the low point of the riser. Along with constant inflow of new liquids this causes a blockage at the base of the riser and starts the next cycle.

Stage 2: Slug Formation—the liquid continues to build up in the riser as a liquid slug. Pressure builds up behind this liquid slug as gas continues to flow into the pipeline.

Stage 3: Slug Production—once the liquid reaches the top of the riser the hydrostatic head can no longer increase and therefore gas pressure overcomes the liquid head and a liquid slug starts to be produced.

Stage 4: Blowout—Once the tail of the slug reaches the base of the riser the gas breaks through and into the riser, expanding to cause a violent acceleration of the liquid slug; after which some liquid falls back down the riser and blocks the riser base thus commencing the next cycle (stage 1).

The main issues associated with production whilst in the severe slugging regime occur due to flooding of the separation systems during the slug production phase of the cycle resulting in poor separation and over pressurisation during the slug blow out stage which can cause the platform to shut down completely. For example, export compressors go into surge mode due to significant variation in the gas flowrates, imposing stress on the shaft/bearings and operational control issues. Sometimes this leads to unwanted flaring of the gas. Furthermore, cyclic surges introduce vibration to the process piping system and mechanical fatigue to the riser, leading to possible earlier failure. Accordingly, it is important that this flow regime can be controlled or mitigated.

Severe slugging can be managed by making use of slug catchers on the topside facilities but these are generally large vessels designed to hold the full liquid slug, thus mitigating any issues of flooding the separation trains. Slug catchers are typically very large and heavy as they have to be designed to withstand the high pressures observed during blowout. As footprint and weight are very important parameters for an offshore platform, there is generally not sufficient space or capability to carry the weight associated with the need for slug catchers. Accordingly, a more compact system is required.

Figure 6:
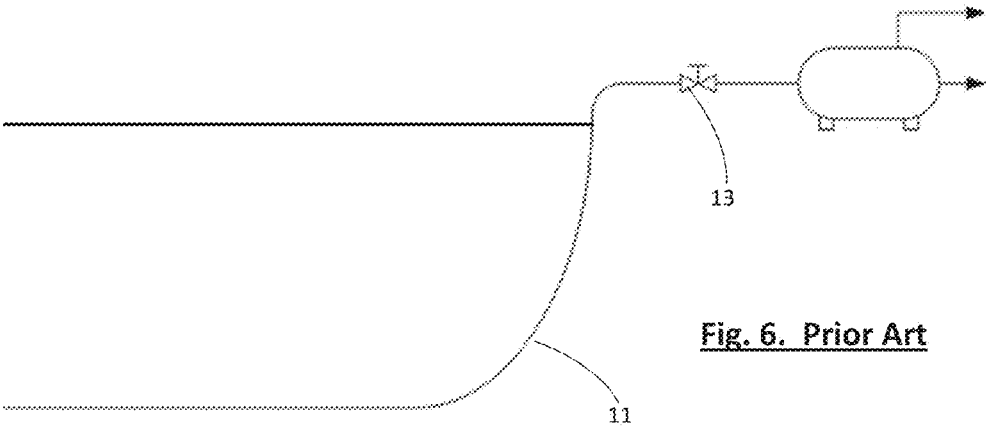
Fig. 6. Prior Art
FIG. 6 illustrates a system having a control/choke valve situated at the top of a riser.

FIG. 6 shows a system that is recognised as a simple fix in the field, namely a control/choke valve 13 situated at the top of the riser 11 that, by throttling the control/choke valve actively imposes a back pressure on the riser which slows down incoming flow, hence restricts the production rate. During the blowout stage of a severe slugging cycle, the higher back pressure acts to decelerate the liquid slug forcing it to mix with the gas in the riser, ultimately stabilising the flow. This method forces the operator to accept a reduction in production to achieve stable flow and may cause some wells to be abandoned. In some cases, the flow is sheared going to downstream processes and makes separation of phases difficult.

If a system can be found that mitigates the severe slugging regime whilst imposing a smaller back pressure on the base of the riser (resulting in changing of the flow regime in the riser and increasing the stable flow region) this will result in a higher production for the operator in a stable manner with minimum operational upsets.

Figure 7:
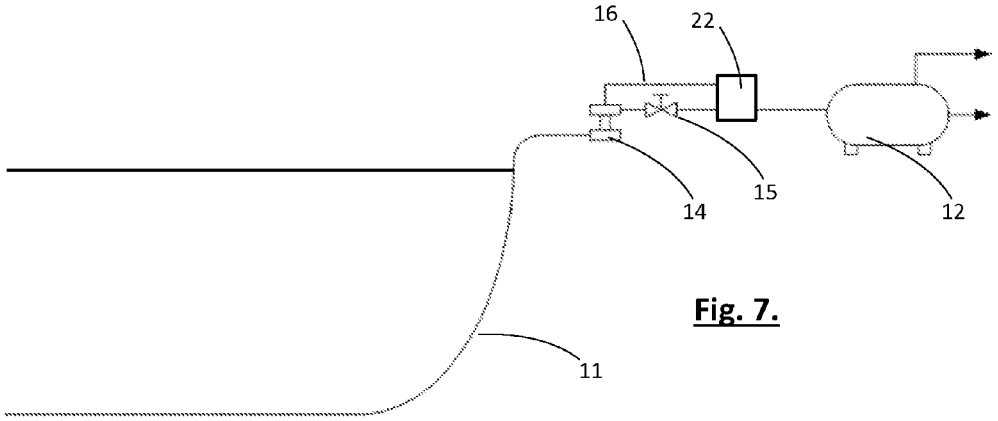
FIG. 7 illustrates as system having an I-SEP and control valve at a top of a riser.

Slug mitigation is possible by an I-SEP alone, but from experimental testing, it has become apparent that by making use of an I-SEP and control valve at the top of the riser, the system could act in a improved way to the use of the throttling valve. Such a system is illustrated by FIG. 7 where an I-SEP 14 is located downstream of the riser 11 (above sea level) and upstream of a throttling valve 15. However, as illustrated, gas separated in a separated gas flow line 16 from the I-SEP 14 is shown to be able to bypass the throttling valve before re-joining the main pipeline prior to connection with the first stage separator 12.

The valve 15 could be substituted by a fixed restriction to add a minor pressure loss, such as a smaller outlet of the I-SEP or a built in orifice plate. This would allow partially separated gas to be reintroduced and mixed before entering the main separator. The mixing point could be a commingler 22, upstream of the first stage separator 12.

Testing has shown that by making use of this system it is possible to mitigate the severe slugging regime with a lower back pressure compared to a control/choke valve (13) only. Early test results and computer simulations have shown that a 10-20% saving in pressure loss can be observed by making use of an I-SEP 14 rather than the control valve; this would result in a higher production rate by making use of the I-SEP rather than the control valve alone.

Figure 8:
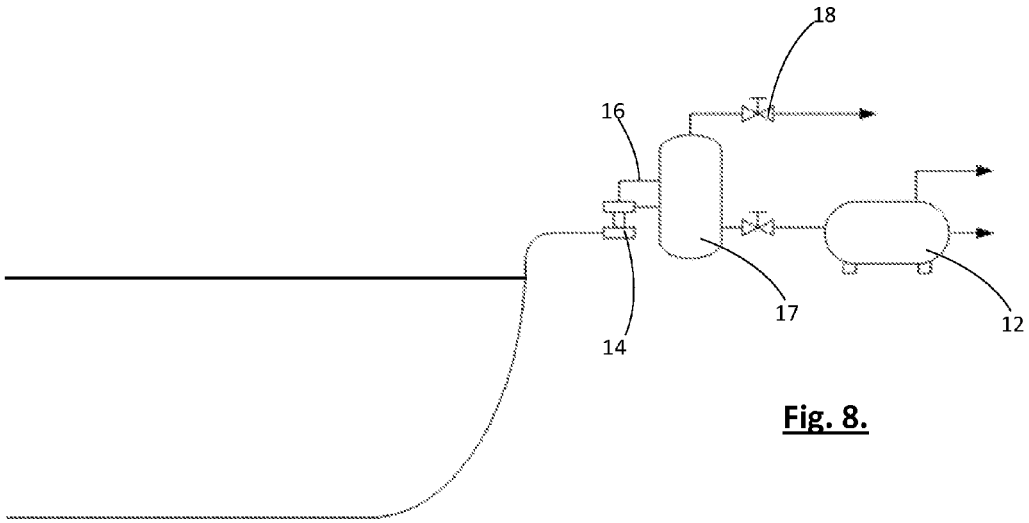
FIG. 8 illustrates an example of how an I-SEP/Hi-SEP combination could be used.

A further advantage of making use of an I-SEP device is its ability to separate gas and liquid that could be beneficial for pipeline riser systems where the first stage separator needs de-bottlenecking. FIG. 8 shows an example of how an I-SEP/Hi-SEP 14/17 combination could be used to mitigate severe slugging and perform a pre-separation on the fluids prior to entering the main separation train. The Hi-SEP component 17 (as described by WO2009/047484) is located downstream of the I-SEP 14, where dense fluid separated therein is piped via a control valve to the first stage separator 12. Gas separated in the Hi-SEP 17 can be piped via a control valve 18 to a compressor.

Figure 9:
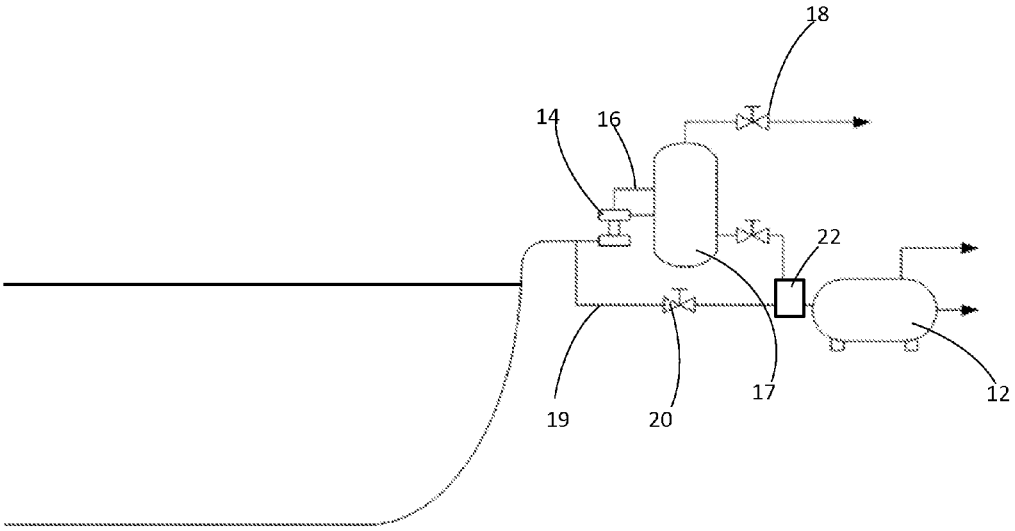
FIG. 9 illustrates a similar design to mitigate severe slugging and perform a gas-liquid separation.

FIG. 9 shows a similar design to that of FIG. 8 that can be used to mitigate severe slugging and perform a gas-liquid separation. This embodiment includes a pipeline 19, bypassing the I-SEP/Hi-SEP components 14/17, directly to the first stage 12 controlled by a control valve 20, such that the pre-separation stage is bypassed. The I-SEP/Hi-SEP arrangement can take part of the flow to debottleneck the main separator and also provide slug mitigation.

Figure 10:
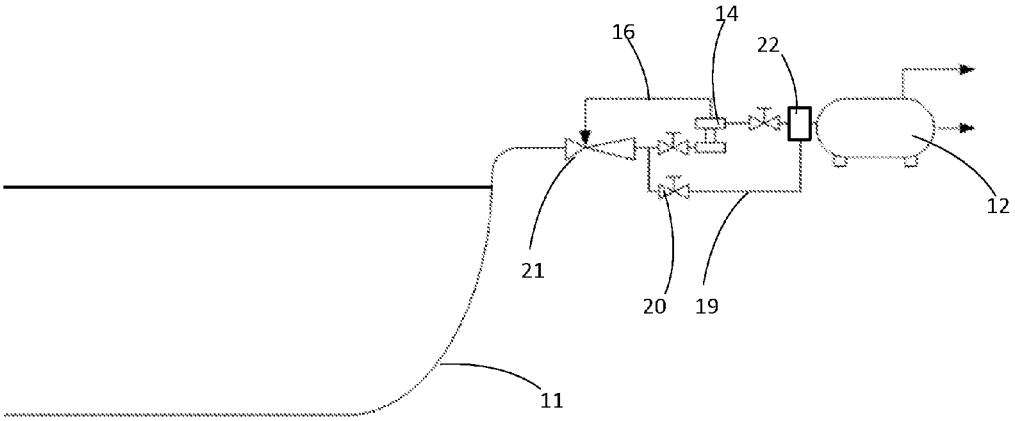
FIG. 10 illustrates an example of making use of the I-SEP for slug mitigation and a jet pump (SJP).

FIG. 10 shows an example of making use of the I-SEP 14 for slug mitigation and a jet pump (SJP) 21, located at the top of the riser 11, upstream of the I-SEP 14, that can be used to re-inject the separated gas flow 16 from the I-SEP 14 and re-inject this back into the main riser-pipeline this also enables mixing of the flow hence changing the flow regime. The outlet valves can be controlled by a slug detection system thus allowing flow diversion based on incoming slug style (part of which is described in our patent application WO2014006371). As illustrated, a bypass line is installed to bypass the I-SEP. Control valves are provided in the bypass line and upstream/downstream of the I-SEP.

It is noteworthy that, for a slug mitigation application as required by the present invention, an I-SEP does not require control valves as no active control is needed, whereas the need for active control is needed in some prior art relating to slug mitigation. Furthermore, the I-SEP does not require a production separator immediately downstream in order to perform.

The present invention seeks to find a system that mitigates a severe slugging regime in a passive way without the need of active control whilst imposing a smaller back pressure on the base of the riser (resulting in changing of the flow regime in the riser and increasing the stable flow region) this will result in a higher production for the operator.

In one broad aspect of the invention there is provided a pipeline system including a riser located between a low level and an upper level of a pipeline, wherein an inline separator is located at the upper level of the pipeline, upstream of a first stage separator. A first control valve is located adjacent the inline separator, this may be either upstream or downstream thereof. In one embodiment, a gas line from the I-SEP is arranged to bypass the throttling valve.

The invention claimed is:

1. A slug mitigation system for subsea pipelines comprising:

a pipeline;

a riser located between a low level and an upper level of the pipeline;

a first stage separator;

an inline separator located at the upper level of the pipeline upstream of the first stage separator;

a first throttling valve or fixed restriction located downstream of the inline separator; and a supplementary cyclonic separator, in combination with the inline separator, upstream of the first throttling valve or fixed restriction, and wherein a gas output line from the supplementary cyclonic separator is directed to a compressor.

2. The slug mitigation system of claim 1 further comprising a valve controlled bypass pipeline connecting to a location upstream of the inline separator and downstream of the first throttling valve or fixed restriction.

3. The slug mitigation system of claim 2 further comprising a commingler located upstream of the first stage separator.

4. A slug mitigation system for subsea pipelines comprising:

a pipeline;

a riser located between a low level and an upper level of the pipeline;

a first stage separator;

an inline separator located at the upper level of the pipeline upstream of the first stage separator; and a jet pump located at the upper level of the pipeline configured to utilize high pressure fluid output from the inline separator.

5. The slug mitigation system of claim 4 further comprising a commingler located upstream of the first stage separator.

6. The slug mitigation system of claim 4 further comprising a throttling valve or fixed restriction located downstream of, or upstream in series with, the inline separator.

7. The slug mitigation system of claim 4 further comprising a gas line from the inline separator arranged to bypass the throttling valve or restriction.

* * * * *